US007811112B2

(12) United States Patent
Montena

(10) Patent No.: US 7,811,112 B2
(45) Date of Patent: Oct. 12, 2010

(54) UNIFORM, HIGH RADIAL CONTACT FORCE PUSH-ON CONNECTOR

(75) Inventor: Noah Parnall Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 79 days.

(21) Appl. No.: 12/362,288

(22) Filed: Jan. 29, 2009

(65) Prior Publication Data

US 2010/0186228 A1 Jul. 29, 2010

(51) Int. Cl.
*H01R 13/52* (2006.01)

(52) U.S. Cl. ..... 439/277; 439/322

(58) Field of Classification Search ..... 439/578, 439/583–585, 320, 322, 277
See application file for complete search history.

(56) References Cited

U.S. PATENT DOCUMENTS 7,717,725 B2 * 5/2010 Montena ..... 439/277

* cited by examiner

*Primary Examiner*—Tho D Ta
(74) *Attorney, Agent, or Firm*—Wyatt, Tarrant & Combs, LLC; William S. Parks

(57) ABSTRACT

A novel, reliable, easy-to-install cable connector requiring a combination of push-on force with minimal torque for proper clamping and sealing to a target port is provided. Such a connector device includes a rubber element that encircles metal contact fingers and which is compressible through tightening of a hand-operable nut to secure contact between the metal contact fingers and the target port. The device also includes a contact basket with at least one cut-out portion that, upon tightening of the nut noted above, deforms into latching engagement with the external threads of the subject port. In such a manner, the inventive cable connector provides a highly effective apparatus for signal transfer, reduced interference and noise ingress, and reliable moisture prevention. A method of providing a signal connection and transfer in a cable system is also encompassed within this invention.

6 Claims, 3 Drawing Sheets

UNIFORM, HIGH RADIAL CONTACT FORCE PUSH-ON CONNECTOR

FIELD OF THE INVENTION

A novel, reliable, easy-to-install cable connector requiring a combination of push-on force with minimal torque for proper clamping and sealing to a target port is provided. Such a connector device includes a rubber element that encircles metal contact fingers and which is compressible through tightening of a hand-operable nut to secure contact between the metal contact fingers and the target port. The device also includes a contact basket with at least one cut-out portion that, upon tightening of the nut noted above, deforms into latching engagement with the external threads of the subject port. In such a manner, the inventive cable connector provides a highly effective apparatus for signal transfer, reduced interference and noise ingress, and reliable moisture prevention. A method of providing a signal connection and transfer in a cable system is also encompassed within this invention.

BACKGROUND OF THE INVENTION

The provision of proper and reliable connectors for cable television systems, at least, has been a recurring issue for many years, particularly now as high definition signals are becoming standard within the industry. Generally, cable (such as coaxial types) connections must exhibit prevention of radio frequency emanations, protection from moisture, dust, and grit, and reliable signal transfer capability. Different connector types have been utilized within the industry, including screw-type mechanisms and push-force apparatuses, to permit transfer of signals from a wall port to a television port via the eponymous cable itself. Such connectors are generally considered the points of reliability for such proper cable installations as the potential for undesirable interference due to poor connections is relatively high. Indoor installations are particularly susceptible to noise ingress problems with variable skill levels in cable installers, the lack of reliability in screw-type connections, the placement of wall ports in edifices (and in relation to the desired location of the television itself), and the problems associated with simple push-on connectors (as friction-based clamps may lose dimensional stability due to fatigue, creep, and/or hysteresis over time), at least. Thus, there is an undesirable high potential for electrical interference within cable systems due primarily to the lack of reliable, secure, connections between the cable and the two ports themselves.

Past attempts to overcome such problematic connection points have included stronger compression connectors, simultaneous clamping and gripping devices to hold target cables in place, and deformable O-ring components alone to increase compression at the connection points at the target ports. Such past improvements have permitted a modicum of increased reliability to reduce potential electrical interference; however, as well these past developments exhibit their own drawbacks, too. For instance, when push-on devices alone are utilized, even with stronger compression forces generated than usual, the resultant connection remains susceptible to creep, fatigue, and/or hysteresis factors. In any physical system that relies solely upon the continued dimensional stability of its component parts, such as, in this situation, the same degree of elastomeric deformation over time and through continued utilization under, again, solely compression forces, there will always be a strong possibility of loss of performance (i.e., the aforementioned creep, fatigue and/or hysteresis). The variability of the sole component providing the compression force remains the weak link in the connection chain, in other words. As such, there remains a distinct probability of performance reduction, if not all out failure, of such a specific elastic connection device. Furthermore, the past developments including such limited improvement bases did not include any extra safeguards to increase the reliability of the connection should creep or fatigue issues occur over time.

Past screw-type mechanisms exhibit similar degrees of noise ingress problems, but for different reasons. As alluded to above, such connections, if undertaken thoroughly by the installer, can be secure in terms of electrical interference; however, that is basically the problem itself. If the installer does not properly screw the connection to the correct location, or if the screw mechanism itself is askew when installed, then potential vibrational influences may loosen the screw leading to the possible compromise of the overall connection itself. Additionally, typical screw-type mechanisms are difficult to operate by hand, but are also placed in hard-to-reach locations for properly configured wrenches to be applied for tightening. As such, and again, the reliability of such connections, which have been predominant in the cable industry in the past, have been highly suspect. The general requirement to tighten such connections through multiple revolutions of the screw portion itself, coupled with the general lack of determinability of the proper level of tightening needed for full contact between the connector and the target port, leads as well to the same type of noise ingress problems that the industry wishes to avoid.

Thus, there exists a need to provide not only a reliable connector, particularly over time, but also one that facilitates installation, even in difficult-to-reach locations indoors. To date, the cable connector art has lacked such a development.

ADVANTAGES OF AND BRIEF DESCRIPTION OF THE INVENTION

One distinct advantage of the inventive cable connection device is the ability to easily affix the connector to either a wall or television (or other device) port with minimal effort but with extra contact through the inclusion of a flexible metal basket compressed by an elastomeric material in a portion of the connection device exterior to its connector body and surrounding the external threads of a target port. Another advantage of the inventive device is simultaneous utilization of a metal spring contact and a rubber compression reinforcement portion without compromising the overall reliability of the entire connection system. Yet another advantage of the inventive device is the optional inclusion of an easily manufactured metal deformable cut-out within the flexible metal basket to permit even more contact between the compressed basket and the port threads upon connection and compression of the elastomeric material surrounding the basket, thereby permitting retention of high degrees of reliability in transmissions after multiple uses. Additionally, the inventive device may be utilized on different types of ports as necessary, thereby exhibiting still another advantage.

Accordingly, this invention encompasses a cable connector comprising a connector body having an inner cavity and an external portion; and a cap (preferably, though not necessarily, circular in shape) having an exterior portion and an interior portion, as well as a top end and a bottom end, said cap being attached to said connector body; wherein said cap further includes a metal basket (preferably, though not necessarily circular in shape as well) placed within the interior portion of said cap and within the top end thereof, wherein said cap further includes an elastomeric reinforcement component situated within a chamber between said metal basket and said interior portion of said cap; and wherein said cap further includes a nut portion that may be rotated around said target port after connection is made, thereby compressing said rubber reinforcement by reducing the volume of said chamber within which said rubber reinforcement resides and thereby enhancing the contact point surface area between said metal basket and said external threads of said target port. Optionally, the metal basket may include at least one cut-out that exhibits a propensity to bend away from the basket portion. Such a cut-out allows for a latching engagement between the port threads and the metal basket to further enhance the connection therebetween. A method of providing a secure, reliable, and easy-to-install cable connection through the insertion of a connection device to which a cable has been attached to a port, wherein the connection is accomplished through applying force axially to the connection device over the port and then rotating a portion of said connection device at most approximately two turns, more preferably at most one turn, and most preferably from one-quarter to one-half of a turn, is also encompassed within this invention.

In such a manner, provided is a cable connection device that permits security and reliability in terms of transmission capability, as well as simplicity in installation. The rubber reinforcement housed between the metal basket portion and the rotating cap of the connection device provides extra desired compression force to the overall connection. In one potentially preferred embodiment the actual connection between the port threads and the metal basket is not made until the nut is rotated and the metal basket is forced into contact with the subject port threads. Alternatively, the cap (and its component parts therein) may be configured to permit an initial connection between the metal basket and the port threads through the axially applied force of pushing the connector body forward onto the port. Once the cap moves into place over the exterior threads of the target port, the metal basket is then pressed upon by the port exterior, which thereby compresses upon the rubber reinforcement as well. Then, in such an alternative embodiment, the nut can be rotated to further crush the metal basket portion onto the threads to ensure a secure connection. In either situation, the reduction in volume within the cavity (chamber) between the metal basket and the interior of the cap within which the rubber reinforcement is housed, thus increases the compression upon the connection as well. In addition, this device then allows for a final introduction of compression force through the tightening of the cap through the aforementioned nut portion via hand (or tool) rotation of the cap approximately at most turn revolutions thereby further deforming the rubber reinforcement to further crush the metal basket contact onto the port. Preferably, in order to reduce the complexity of securing the connection, the chamber in which the elastomeric component resides may be reduced in volume to permit the installer to secure the connection with at most one turn of the nut; even more preferably, less than a full revolution of the nut can be undertaken, with one-quarter to one-half of a turn most preferred for such a secure connection to be obtained.

Such a connection device thus, in this initially preferred embodiment, serves to increase reliability of signal transmission (which, as noted to above, is very important particularly with the advent of high definition transmissions becoming the norm in the cable industry) through secure connections of the cable connection device to the target port itself. The rubber reinforcement coupled with the extra metal basket connection aids in securing contact between the cable post and the target port thus preventing extraneous interference due to the extreme compression of the cap portions to the target port itself, with high compression forces, particularly when applied in two separate manners, the connection between connector body and port is very difficult to undo. Furthermore, reducing the volume of the chamber housing the rubber reinforcement accomplishes the desired increase in compression force to the metal basket portion since the pressure exerted upon the rubber reinforcement moves the component parts in the direction of least resistance, in this case, toward the target port, again increasing the connection forces thereto.

As noted previously, in addition to this initial configuration, also optionally available to provide even greater reliability to the overall connection is the provision of a cut-out within the metal basket portion. Such a cut-out is, in essence, a deformation in the metal basket portion itself, but in the manner that the resultant cut-out exhibits the propensity to bend in the direction of the middle of the circular metal basket itself. In other words, the cut-out should extend inward toward the area in which the target port will reside upon connection to the connector body, but in a manner that prevents or impedes the entry of the target port into the connector cap itself. The cut-out, being metal itself, will thus supply an extra area for contact with the external threads of the target port once the connection is made. In this manner, even if the rubber reinforcement portion exhibits a reduction in compression force over time, the extended cut-out portion will permit reliable contact between the metal basket and the target port since the cut-out will remain, for the most part, extended toward the target port at all times, thereby providing a latch effect to enhance the connection between the connector and the port. With the threads of the port in essence forming a helical structure, the cut-out would preferably exhibit a configuration to angle downward toward the threaded portions in order to latch into the recessed areas therein. A C-shaped cut-out, as merely one possible example, provides such a configuration whereby the concave portion of the C may latch onto the threads when the connection and compression is undertaken as noted above. The metal material of the metal basket (and thus of the cut-out) must exhibit sufficient resiliency to permit the cut-out portion to remain securely latched in such a manner that it does not prevent proper connection between the connector body and the target port, as well as retains its initial configuration once the connection is disengaged, and, furthermore, does not maneuver itself in any way into the chamber in which the rubber reinforcement resides. Furthermore, upon relaxation (i.e., unscrewing) of the nut component, the cut-out should easily disengage itself from the target port threads thus permitting full disengagement of the connector from the port. Other potentially preferred cut-out configurations include half rectangles, half squares, half rhombuses, and other like shapes that will permit the similar degree of secure connection upon compression as discussed above.

The rubber reinforcement may be any elastomeric material that exhibits proper compressibility to exert force upon the metal basket portion noted above for proper and reliable contact with a target port to occur. Such an elastomer may thus be thermoplastic rubber (such as, as one example, Santoprene™ from ExxonMobil), and thermoset rubber, such as, as examples, natural rubber, styrene butadiene rubber, nitrile butadiene rubber, or ethylene-propylene diene monomer rubber, urethane rubber, and silicone rubber. For the purpose of desired elasticity under a wide range of potential pressures and temperatures, silicone rubber is particularly preferred for this application.

The connector body is preferably a conductive metal, as would be the metal basket portion of the cap. Thus, copper, gold, silver, aluminum, brass, spring steels (stainless), and the like, are preferred for such a purpose. The cap and the exterior of the connector body would preferably be plastic, such as polycarbonate, polyacrylic, acetal, etc., in order to reduce costs, provide insulation to the overall connection, and permit ease in handling for an installer or consumer. The nut may be a nonconducting material of moldable plastic (nylon, acetal, for instance) or metal (such as die-cast zinc, machined brass, as one example), as well. The connector body may be itself configured in any way to connect with any type of port as well. Thus, although standard cable television ports, f-type, etc., or the most common, the connector body may be configured for RCA and PAL connections (among others), too. The cap and its component parts are provided in a configuration that may be utilized with any type of target port and thus any type of connector body as the metal basket portion and the rubber reinforcement component do not rely upon specific connection types themselves. Thus, the versatility of the cap, which may be itself a separate device that can be attached to a particularly formed connector body (dependent upon the design and complementary shape of the exterior thereof in relation to the cap) provides an excellent manner of extra security to an installer and thus a consumer for cable television (and other coaxial cable connection use) needs.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown in the drawings. In the figures, the same reference numerals are used to indicate the same elements of each of the illustrated boards.

DETAILED DESCRIPTION OF THE DRAWINGS

Figure 1:
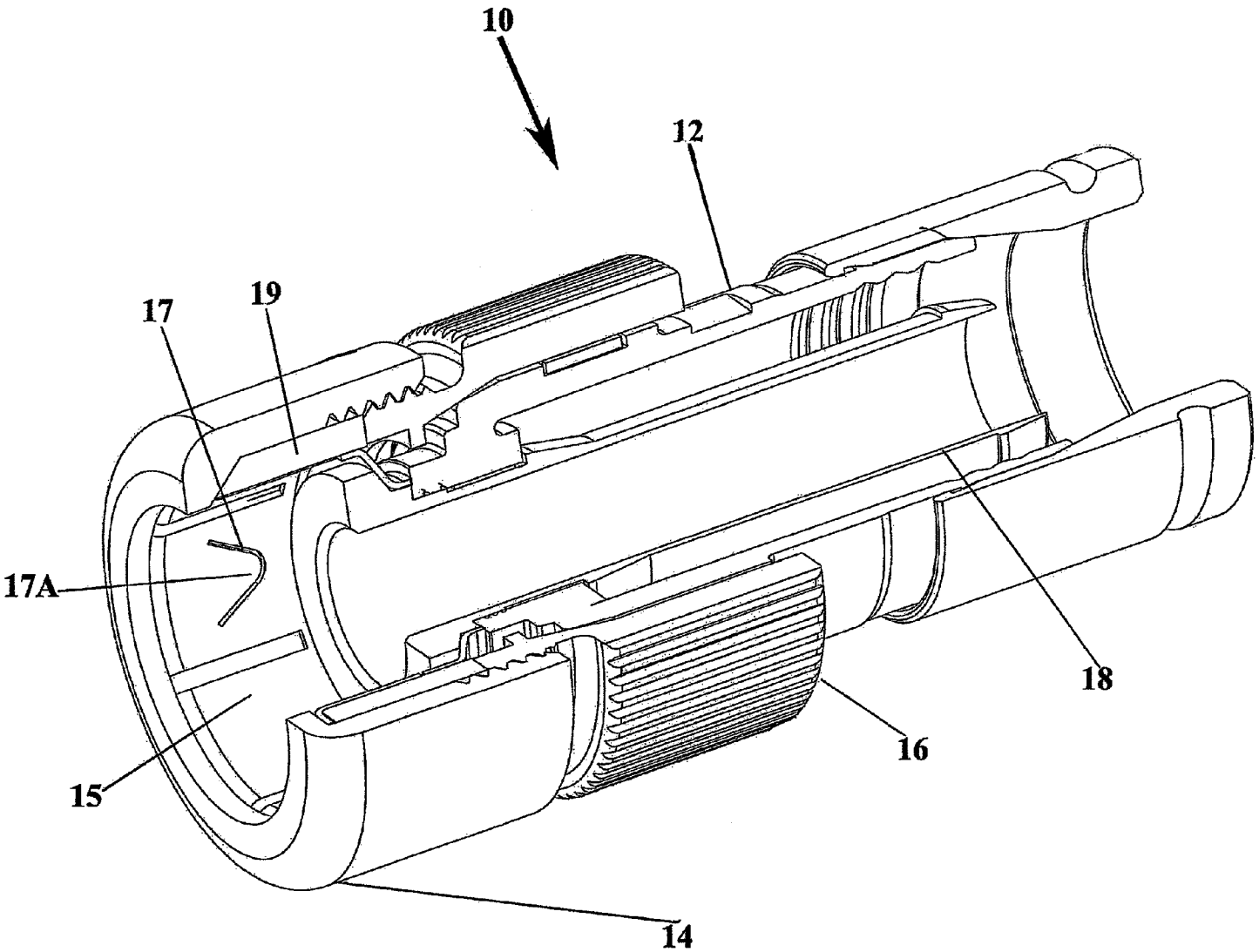
FIG. 1 depicts a partial cutaway view of a preferred embodiment of the invention.

FIG. 1 shows one potentially preferred embodiment wherein both a compressible metal basket and a metal cut-out are both present. A cable connector 10 includes a connector body 12 to which a cap 14 is connected. The cap 14 overlaps a nut 16 that is threaded to allow for a rotation of the cap 14 around a cable port (not illustrated) or another connector (not illustrated). A post 18, extending inside the connector body 12, is connected to both the cap 14 (albeit loosely to allow for the aforementioned rotation) and the connector body 12. The cap 14 further includes a metal basket portion 15, which includes a metal cut-out 17, and an elastomeric reinforcement member 19, present between the basket portion 15 and the interior of the cap 14 (also referred to as the nut). As alluded to above, the insertion of a target port (not illustrated) into the cap 14 allows for contact with the post 18 for proper transmission to the target cable (not illustrated). As noted above, one alternative is to configure the cap 14 and metal basket portion 15 to fit rather snugly over the target port (not illustrated) in radial fashion to effectuate an initial compression of the elastomeric reinforcement member 19 upon the presence of the target port (not illustrated) within the cavity of the cap 14. Preferably, however, the target port (not illustrated) is introduced within the cap 14 wherein the metal basket 15 is either not in contact or loosely touching the target port (not illustrated). The nut 16 can then be rotated to compress (or further compress) the elastomeric reinforcement member 19 through reduction of volume within the chamber in which it resides between the metal basket portion 15 and the interior surface of the cap 14. As a result, the metal basket portion 15 then flexes inward toward the external threads of the target post (not illustrated) to an even greater degree to increase the contact pressure. The metal cut-out 17, here in a C-shape with the interior portion 17A extended into the cavity of the cap 14, is also compressed into the external threads of the target post (not illustrated) as a result of both the target post insertion as well as the rotation of the nut 16. The metal cut-out 17, as noted above, may be of any shape that permit such extension into the cavity of the cap 14 and thus reliable pressure connection with the target post (not illustrated). Any number of metal cut-outs may be present for this purpose.

Figure 2:
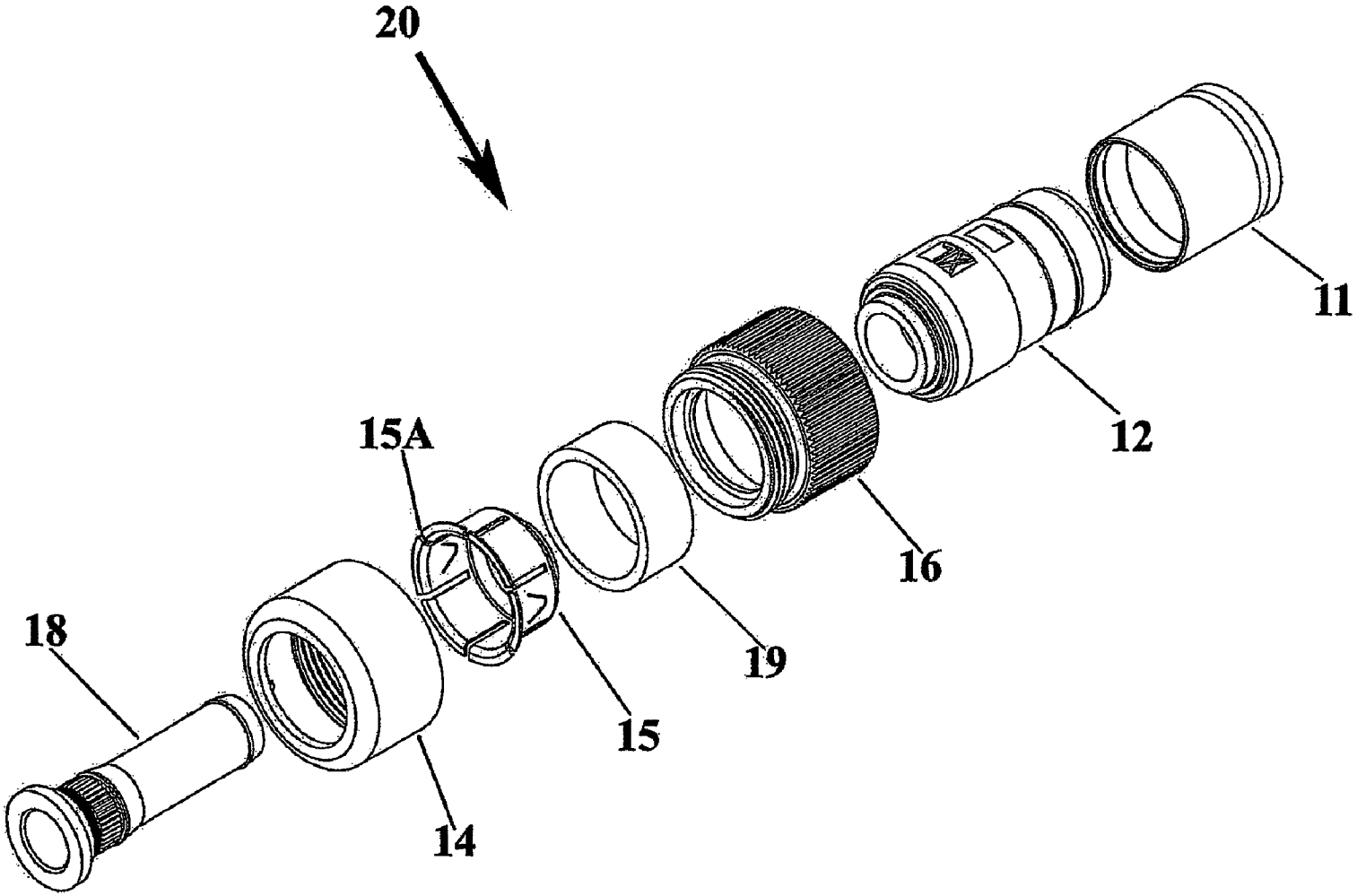
FIG. 2 depicts an exploded view of the same embodiment as in FIG. 1.
Figure 3:
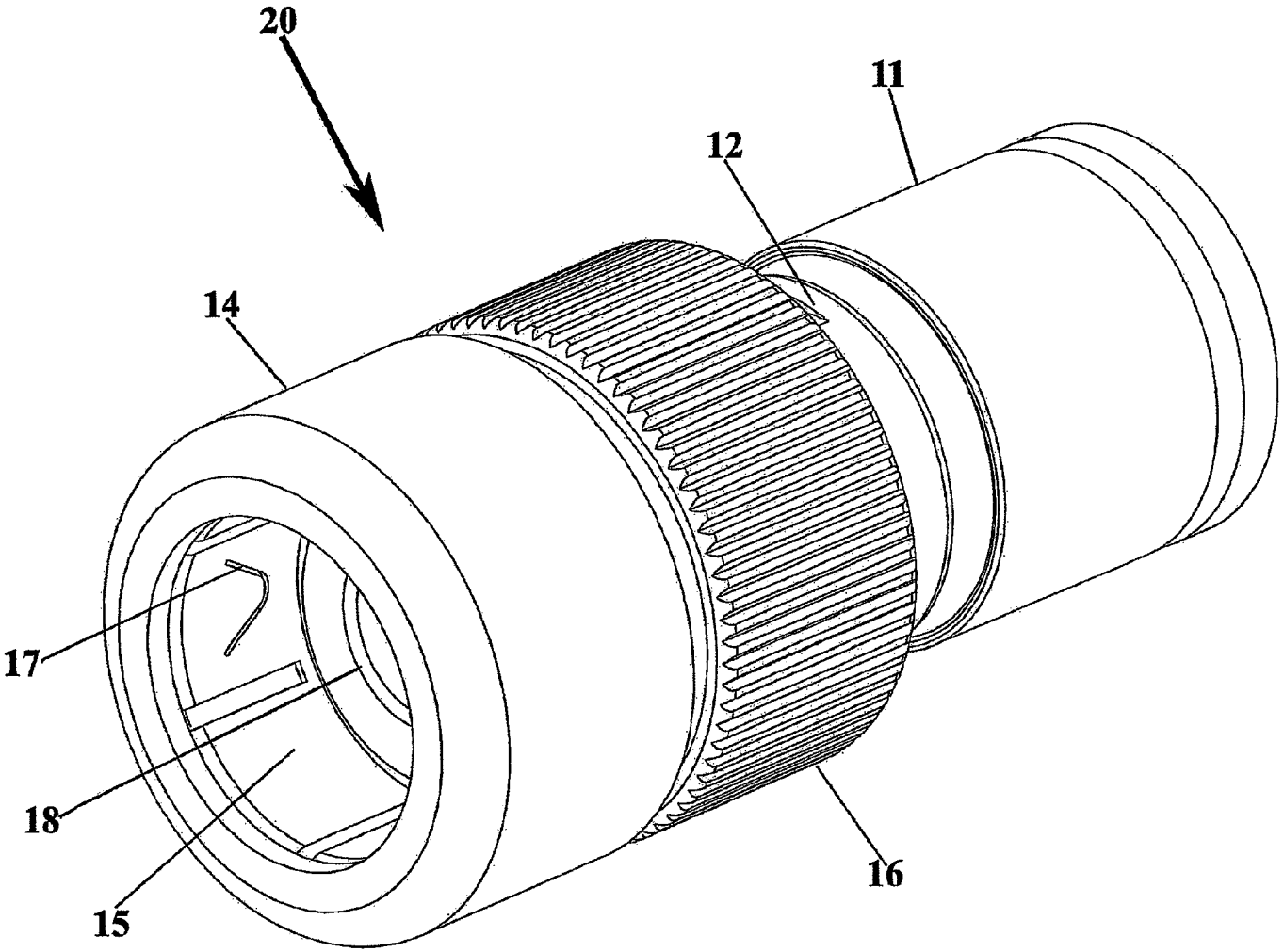
FIG. 3 depicts a perspective view of the same embodiment as in FIG. 1.

FIG. 2 thus shows the individual components of the entire connection device assembly 20. The post 18 fits into the entire connector body 12, with a sheath 11 to cover the connector body present as well. Rotatably attached to the connector body 12 is the nut 16, which is covered in overlapping fashion by the cap 14. Within the cap 14 and nut 16 are the metal basket portion 15 and the elastomeric (rubber) reinforcement member 19 with the elastomeric member 19 encircling the metal basket 15. The metal basket portion 15 has a lip portion 15A which, is forced inward upon compression upon the elastomeric reinforcement member 19 by the rotated nut 16.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A cable connector comprising a connector body having an inner cavity and an external portion; and a cap having an exterior portion and an interior portion, as well as a top end and a bottom end and a cavity therein, said cap being attached to said connector body; wherein said cap further includes a metal basket placed within the interior portion of said cap and within the top end thereof, wherein said cap further includes an elastomeric reinforcement component situated within a chamber between said metal basket and said interior portion of said cap; and wherein said cap further includes a rotatable nut portion that, upon rotation, compresses said elastomeric reinforcement component which in turn compresses said metal basket inward into the cavity within said cap.

2. The cable connector of claim 1 wherein said cap, said metal basket, and said elastomeric reinforcement component are all circular in shape.

3. The cable connector of claim 1 wherein said metal basket includes at least one cut-out therein that exhibits a propensity to bend away from the basket portion into said cap cavity.

4. The cable connector of claim 3 wherein said cut-out is V-shaped.

5. The cable connector of claim 3 wherein said cap, said metal basket, and said elastomeric reinforcement component are all circular in shape.

6. The cable connector of claim 4 wherein said cap, said metal basket, and said elastomeric reinforcement component are all circular in shape.

* * * * *